US005249839A

United States Patent [19]

Faiks et al.

[11] Patent Number: 5,249,839

[45] Date of Patent: Oct. 5, 1993

[54] SPLIT BACK CHAIR

[75] Inventors: Frederick S. Faiks, Greenville; Carl V. Forslund, III, Grand Rapids; Robert M. Scheper, Grand Rapids; Craig M. Anderson, Kentwood, all of Mich.

[73] Assignee: Steelcase Inc., Grand Rapids, Mich.

[21] Appl. No.: 790,348

[22] Filed: Nov. 12, 1991

[51] Int. Cl.[5] ..... A47C 3/00

[52] U.S. Cl. ..... 297/301; 297/284.4

[58] Field of Search ..... 297/301, 304, 300, 322, 297/354, 353, 284.4, 284.7, 457

[56] References Cited

U.S. PATENT DOCUMENTS

| | | | |
|---|---|---|---|
| 4,756,575 | 7/1988 | Dicks | 297/301 X |
| 4,981,325 | 1/1991 | Zacharkon | 297/353 X |
| 4,981,326 | 1/1991 | Heidmann | 297/300 X |
| 5,042,876 | 8/1991 | Faiks | 297/304 |

FOREIGN PATENT DOCUMENTS

| | | | |
|---|---|---|---|
| 2360165 | 6/1975 | Fed. Rep. of Germany | 297/284.4 |
| 2501673 | 7/1975 | Fed. Rep. of Germany | 297/354 |
| 3125312 | 1/1983 | Fed. Rep. of Germany | 297/354 |

*Primary Examiner*—Laurie K. Cranmer

*Attorney, Agent, or Firm*—Price, Heneveld, Cooper, DeWitt & Litton

[57] ABSTRACT

A chair, with independent control of a lumbar portion of a seat back and a thoracic portion of the seat back, has a seat connected with a base and a control connected with the base, generally under the seat. A first support, pivotally connected with the control, extends from the control to the thoracic portion of the seat back. A second support, pivotally connected with the control, extends from the control, to the lumbar portion of the seat back. The two supports operate independently and the thoracic and lumbar portions of the seat back rotate independently rearward with respect to the seat, providing sympathetic back support for a user. The thoracic portion may rotate laterally to follow twisting movements of a user's thoracic region. The lumbar portion may be connected with the second support to limit lateral rotation of the lumbar portion.

38 Claims, 5 Drawing Sheets

SPLIT BACK CHAIR

BACKGROUND OF THE INVENTION

The present invention relates to seating and in particular to control of a back support portion of a chair.

It is known to provide various lumbar support devices to support the back of a user properly and comfortably. Back support portions of known chairs generally dictate the positioning and allowable movements of a user's back. These devices are commonly fabricated according to a model representing a compromise of the range of forms and shapes of the ultimate users of the chair. The actual user seldom matches the composite model. The user is inevitably required to adapt to the chair, rather than having the chair adapt to the user. Thus, prior art chairs can cause stress and fatigue in the user.

SUMMARY OF THE INVENTION

A chair according to the present invention departs from the dictatorial back supports of prior chairs with a sympathetic back support mechanism, having designed motions adapted to follow and support the natural body motions of the user and thereby minimize seating stress and fatigue. The chair has a seat connected with a base, a control connected with the base and disposed generally underneath the seat, and a back support portion connected with the control. The back support has a lumbar portion positioned to contact at least a portion of a lower back area of a user and a thoracic portion positioned to contact at least a portion of an upper back area of the user. A first or thoracic support is pivotally mounted in the control and extends to connect with the thoracic portion of the back so that the thoracic portion rotates rearward with respect to the seat. A second or lumbar support pivotally connects with the control and with the lumbar portion of the back. The lumbar portion also rotates rearward with respect to the base. The first and second supports operate independently so that the thoracic and lumbar portions rotate independently and independently follow the lower and upper areas, respectively, of the user's back, achieving a natural, free-floating chair back motion and providing generally continuous, sympathetic back support.

In narrower aspects of the invention, a flexible transition zone is provided between the lumbar and thoracic portions of the back. The thoracic portion of the back is connected with the first support so that the thoracic portion rotates laterally to follow twisting movements of a user's upper back region. The lumbar portion of the back is connected with the second support to minimize lateral rotation of the lumbar portion. The first support, connected with the thoracic portion of the back, is a telescoping member. The second support is connected with the lumbar portion of the back by a height adjustment mechanism for adjusting the height of the back relative to the seat.

These and other objects, advantages and features of the present invention will become apparent upon review of the following specification in conjunction with the drawings.

DESCRIPTION OF THE PREFERRED EMBODIMENT

Figure 1:
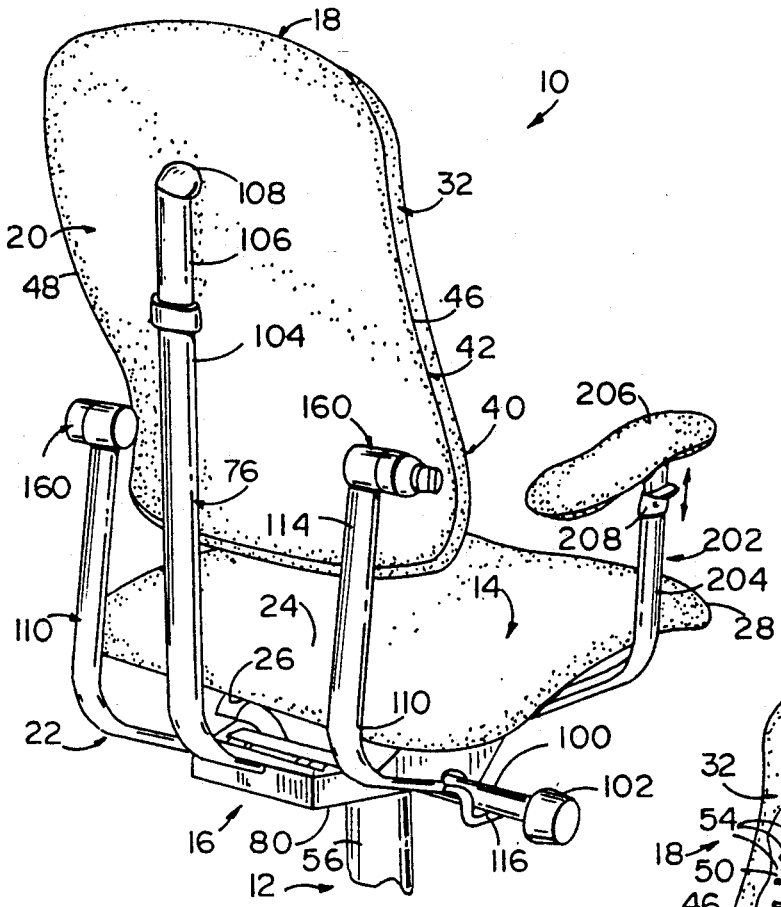
FIG. 1 is a rear perspective view of a chair according to the present invention.

A chair 10 according to the present invention is generally shown in the figures and comprises a base 12, a seat 14, a control 16, a back 18, a first or thoracic support 20, and a second or lumbar support 22 (FIG. 1). As discussed below, thoracic support 20 includes a thoracic support arm and a thoracic energy mechanism and lumbar support 22 includes lumbar support arms and a lumbar energy mechanism.

Seat 14 may be any of various known constructions, preferably comprising a molded, upholstered chair cushion assembled to a structural shell and is most preferably constructed according to the commonly assigned U.S. Pat. No. 4,718,153, entitled CUSHION MANUFACTURING PROCESS and issued on Jan. 12, 1988, to Armitage et al., which is hereby incorporated by reference. Seat 14 has a structural shell (not shown) preferably constructed of a resilient, semi-rigid, synthetic resin material, which normally retains its molded shape, but permits some flexing such as, but not limited to, polypropylene or fiber reinforced plastic for example.

Seat 14 is preferably molded with a generally concave surface forming a shallow bowl 24 near a rear edge 26 to receive and support the buttocks of a user (FIGS. 1, 2, 5, and 6). Seat 14 becomes planar and rolls off gently toward a forward edge 28 of the seat to support the rear of the thighs of the user. Thus, seat 14 provides a gentle release of support under the user's leg, avoiding a harsh transition line where the thighs leave the support of seat 14, at front edge 28.

Figure 2:
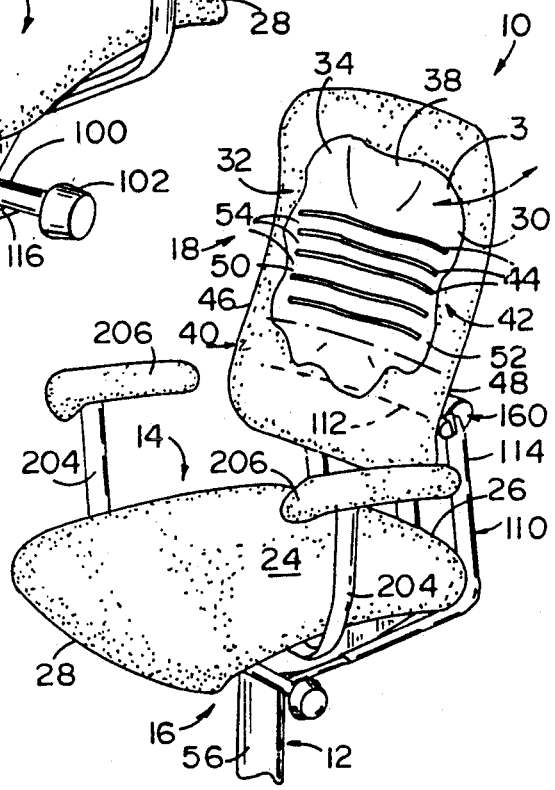
FIG. 2 is a front perspective view of the chair of FIG. 1 with a portion of the back support shell revealed.

Back 18 includes a structural shell 30 and has a complexly curved surface (FIG. 2). An upper thoracic portion 32 for contacting and supporting at least a portion of the user's upper back area, extends over the upper approximately one-third of back 18 and has two shallow, concave areas 34, 36, symmetrically positioned to either side of a center line spinal support ridge 38. Ridge 38 presents a subtly convex region between the concave areas 34, 36 to gently support the user's thoracic spine. Generally, thoracic portion 32 provides subtle, wraparound support to the user's thoracic region.

Figure 5:
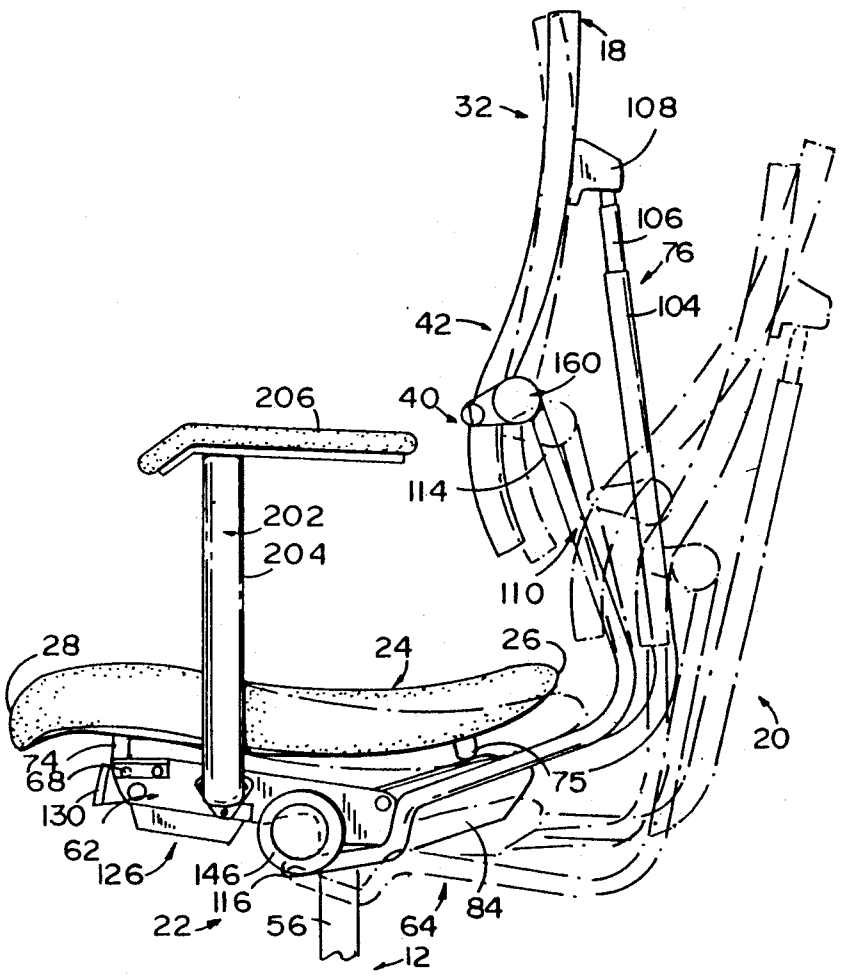
FIG. 5 is a side elevational view of the chair of FIG. 1 showing the motion of the back support structure in phantom.
Figure 6:
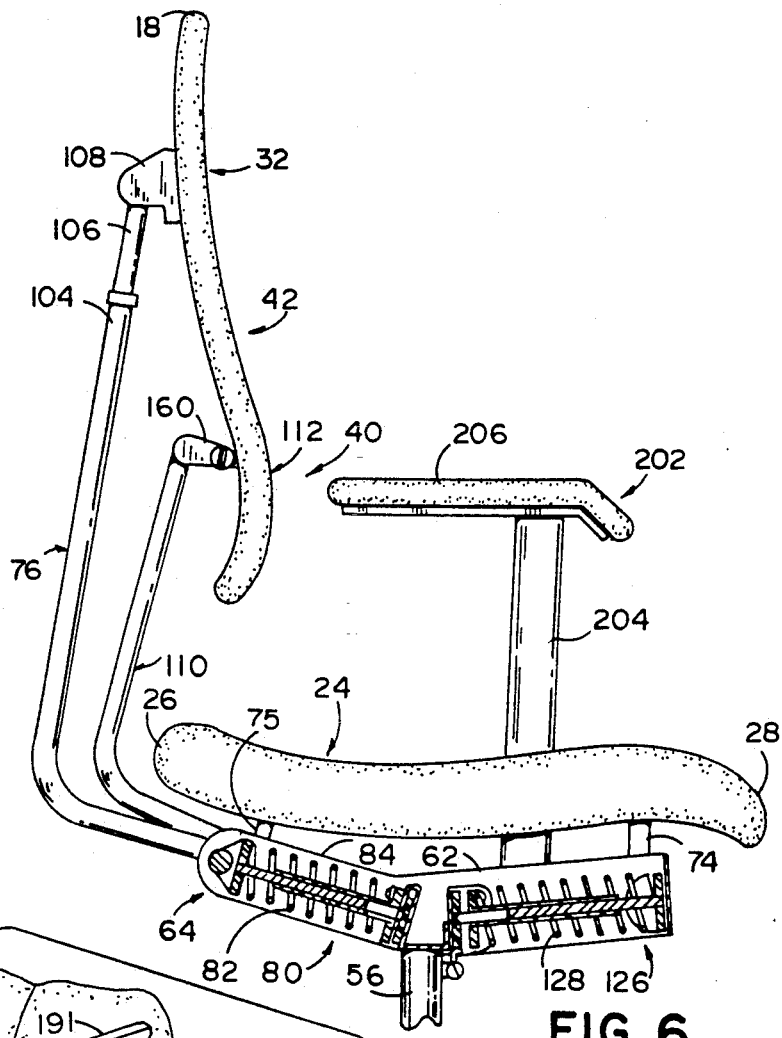
FIG. 6 is a center line sectional view of the chair of FIG. 1.

Back 18 also has a lower or lumbar portion 40 for contacting and supporting at least a portion of the lower back area of the user (FIGS. 2, 5, and 6). Lumbar portion 40 is preferably molded with a shallow, transversely concave curvature to provide subtle, wraparound support to the lumbar region of the user's back. Lumbar portion 40 also has a longitudinally convex curvature to support the lumbar region of a user's back and provide a gentle release of support toward the user's hips, avoiding a harsh transition line.

A flexible transition area 42 extends between thoracic portion 32 and lumbar portion 40 (FIGS. 2, 5, and 6). Transition area 42 comprises a series of slits 44 extending transversely, generally horizontally, across structural shell 30 and terminating near, but spaced away from, each of two opposing lateral edges 46 and 48 of structural shell 30. A pair of vertically extending straps or living hinges 50 and 52 are defined between slits 44 and lateral edges 46 and 48. Hinges 50 and 52 extend between thoracic portion 32 and lumbar portion 40. A series of transverse webs 54 are defined between slits 44. Webs 54 extend between the living hinges 50, 52.

As with seat 14, back 18 preferably has a construction comprising a molded, upholstered chair cushion assembled to structural shell 30 according to Armitage et al. '153, above. Structural shell 30 is preferably constructed of a resilient, semi-rigid, synthetic resin material, which normally retains its molded shape, but permits some flexing. Such material may include, but is not limited to polypropylene for example. Slits 44 enhance the flexibility of structural shell 30 in transition area 42, maximizing the freedom of movement between thoracic portion 32 and lumbar portion 40, yet allowing a minimal reliance between thoracic portion 32 and lumbar portion 40 for proper, generally vertical presentation of each portion 32, 40 to the user when the user sits in chair 10 (FIGS. 2, 5, and 6). Each of the thoracic and lumbar portions 32, 40 are pivotally connected with control 16, enhancing response of each portion to the user's movements. If thoracic portion 32 and lumbar portion 40 were not interconnected by flexible transition area 42, each portion 32, 40 would pivot under the pull of gravity and face generally downward when not in use, requiring inconvenient initial adjustment of each of the thoracic and lumbar portions 32, 40 by the user when initially sitting in chair 10.

Seat 10 and back 18 are connected with base 12 by control 16. Base 12 may be any of the commonly known chair bases, but preferably comprises a height adjustable column 56 supported by five equally spaced, radially extending legs (not shown) which are supported above a floor by casters (not shown), located at the end of each leg, away from column 56. An example of such a base may be found in the commonly assigned U.S. Pat. No. 4,262,871, entitled PLASTIC ENCAPSULATED BASE and issued on Apr. 21, 1981, to Kolk et al. Column 56 is preferably a telescoping unit for height adjustment of seat 14 above the floor, and most preferably has a pneumatic height adjustment mechanism 60. An example of a suitable pneumatic height adjustment mechanism is disclosed in the commonly assigned U.S. Pat. No. 4,485,996, entitled HEIGHT ADJUSTOR FOR FURNITURE and issued on Dec. 4, 1984 to Beukema et al.

Figure 7:
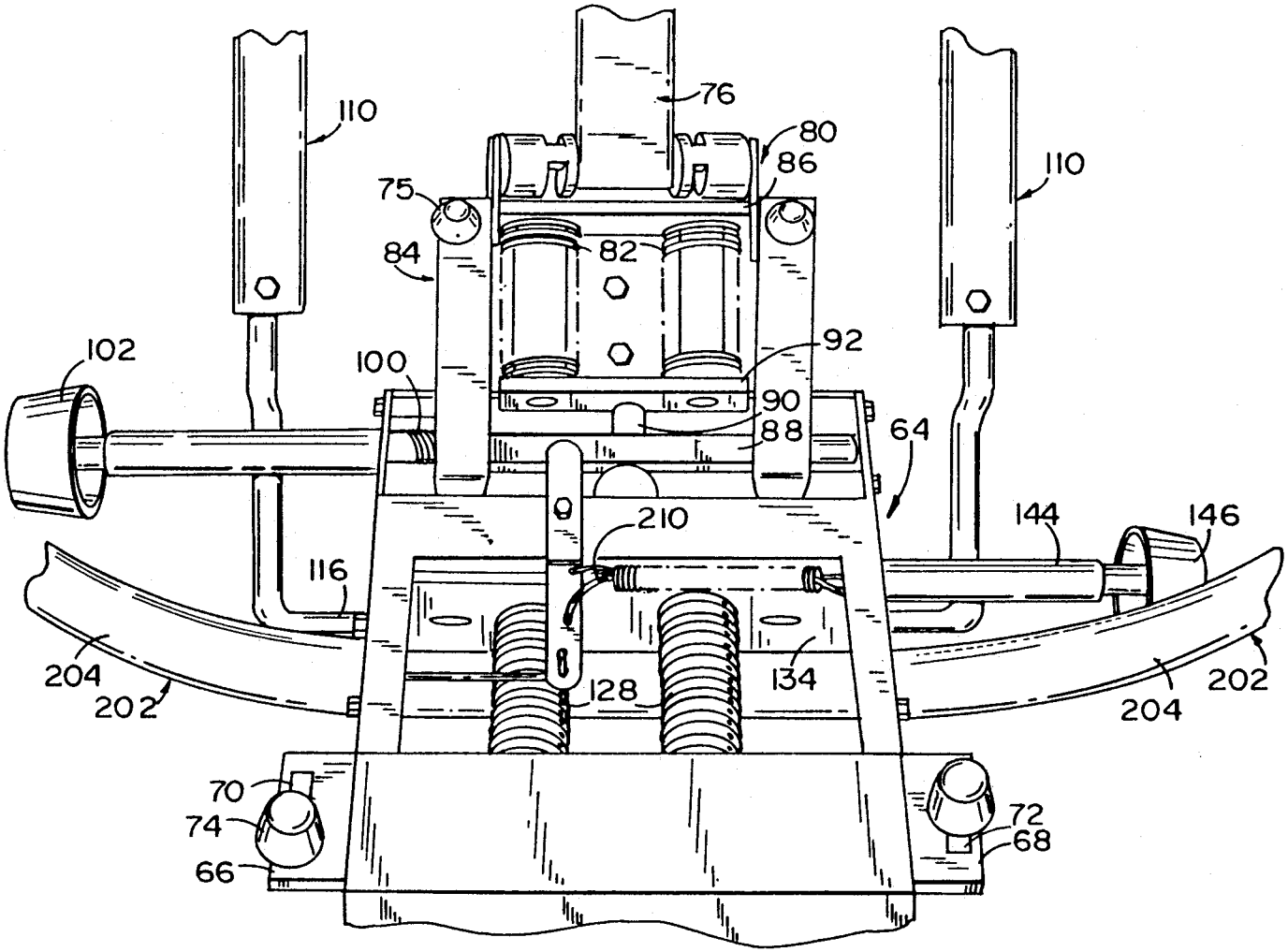
FIG. 7 is a top perspective view of the control portion of the chair of FIG. 1.

Control 16 has a stamped steel housing 62 conventionally attached to the top of base column 56, preferably by welding (FIGS. 5–7 and 9). A synchrotilt mechanism 64, described in greater detail below, is provided in a rear portion of control 16, relative to chair 10, for connection with and support of the rear area of seat 14, near rear edge 26, and thoracic portion 32. Symmetrical left and right seat mounting brackets 66 and 68 are provided near the front of control housing 62 for mounting the forward area of seat 14 near forward edge 28 (FIGS. 5 and 7). Mounting brackets 66 and 68 preferably allow the front portion of seat 14 to slide rearward, relative to chair 10, when thoracic portion 32 is reclined, relative to seat 14 (FIG. 5). Thus, the mounting brackets 66, 68 have elongated apertures 70 and 72, respectively, and seat 14 is preferably mounted to the brackets 66, 68 by suitable fastener assemblies 74, extending through the apertures 70, 72 and slideably engaging the brackets 66, 68 (FIGS. 5 and 7).

A generally L-shaped thoracic support arm 76 is pivotally connected with control housing 62 at pivot 78 and extends rearward and upward to pivotally connect with thoracic portion 32 (FIGS. 1, 5, and 6). The rear portion of seat 14 is connected with thoracic support arm 76 by fastener assemblies 75 (FIGS. 4–7). Thus, as support arm 76 pivots rearward, with the recline of thoracic portion 32, the rear area of seat 14 moves downward and rearward with thoracic support arm 76 and the front area of seat slides 14 rearward, along left and right seat mounting brackets 66 and 68 (FIG. 5).

Figure 9:
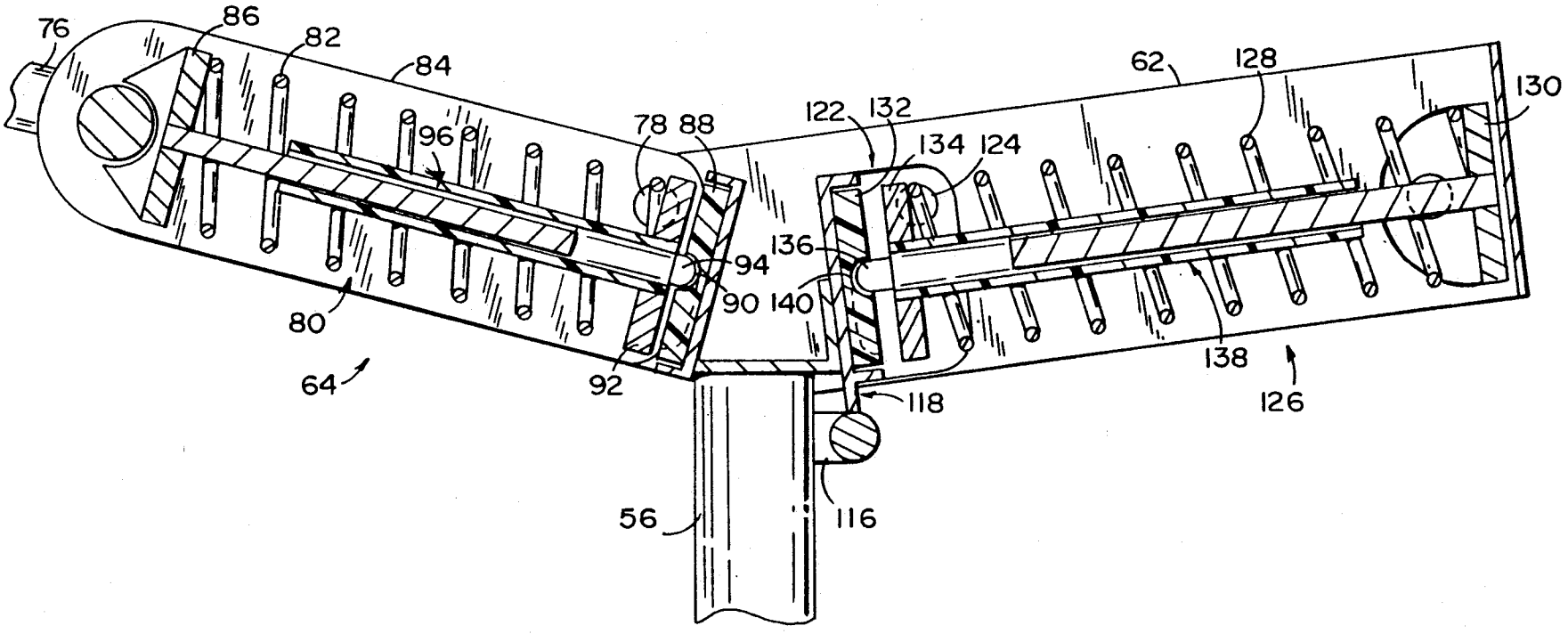
FIG. 9 is an enlarged center line sectional view of the control for the chair of FIG. 6.

Thoracic support arm 76 is biased toward a generally upright position by a thoracic energy mechanism 80, located in synchrotilt mechanism 64 and having thoracic springs 82 (FIGS. 7 and 9). Arm 76, energy mechanism 80, and synchrotilt mechanism 64 comprise thoracic support 20. Thoracic springs 82 are preloaded with a predetermined amount of compression when thoracic support arm 76 is in its normal or upright position. Thoracic springs 82 are specifically located within a synchrotilt pivot housing 84 and bear against a bearing plate 86 which is pivotally connected with synchrotilt pivot housing 84 (FIGS. 5–7 and 9). Synchrotilt pivot housing 84 is pivotally connected with control housing 62 at pivot 78 and thoracic support arm 76 is pivotally connected with housing 62 through synchrotilt pivot housing 84 (FIG. 9).

Opposite thoracic springs 82 from bearing plate 86, thoracic springs 82 press against control housing 62 through a lever arm slide plate 88 (FIG. 9). Lever arm slide plate 88 is a generally rectangular plate member having a channel or groove 90 which extends diagonally across one face of plate 88 and faces thoracic springs 82. Slide plate 88 is positioned generally below pivot 78. Thoracic springs 82 bear against slide plate 88 through a pressure plate 92 and a pressure finger 94 which projects from pressure plate 92. Pressure finger 94 projects generally away from thoracic springs 82, toward slide plate 88. Finger 94 is generally centered on pressure plate 92 and slideably engages diagonal groove 90. To assure the stability of thoracic springs 82 and that the springs do not become displaced, a telescoping stability or safety rod 96 extends through each thoracic spring 82, between bearing plate 86 and pressure plate 92. Safety rod 96 is attached to each of bearing plate 86 and pressure plate 96 and maintains the plates in a generally parallel orientation with respect to each other.

Figure 4:
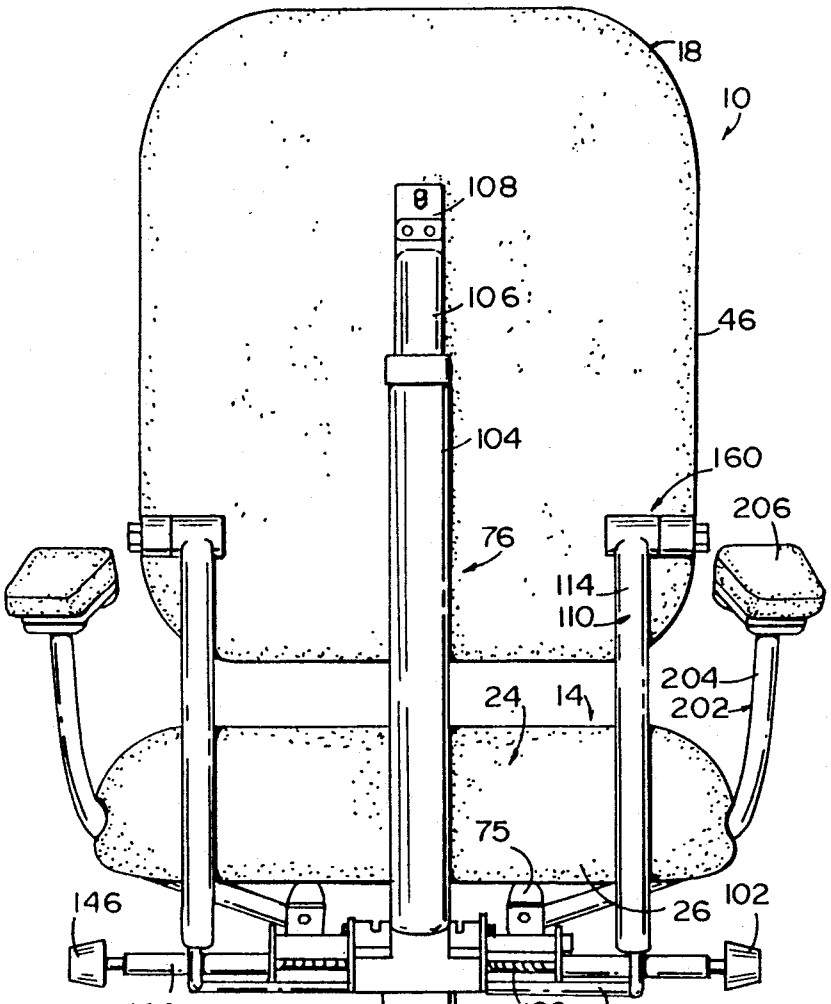
FIG. 4 is a rear elevational view of the chair of FIG. 1.

A threaded adjusting rod 100 is fixed to slide plate 88 at one end of the slide plate (FIG. 4). Adjusting rod 100 extends through control housing 62 and engages a first control nut (not shown). The control nut is rotatably mounted with control housing 62 and connected with a hand grip 102 for rotating the control nut. As hand grip 102 is manipulated, slide plate 88 is pushed or pulled laterally, relative to control housing 62 (FIGS. 7 and 9). As slide plate 88 moves laterally relative to control housing 62, slide plate 88 also moves laterally relative to pressure plate 92 and pressure finger 94. Thus, pressure finger 94 slides along groove 90 and the diagonal orientation of groove 90 moves pressure finger 94 nearer to or farther from pivot 78. This changes the geometry by which thoracic springs 82 exert energy between control housing 62 and synchrotilt pivot housing 84, adjusting the thoracic biasing force accordingly. As discussed in greater detail in commonly assigned U.S. Pat. No. 5,026,117, entitled CONTROLLER FOR SEATING AND THE LIKE and issued on Jun. 25, 1991, to Faiks et al., which is incorporated herein by reference and which teaches a similar geometry in a different structure, the biasing force is adjusted by modifying the control geometry, specifically the pivot moment arm, without changing the spring force.

Figure 3:
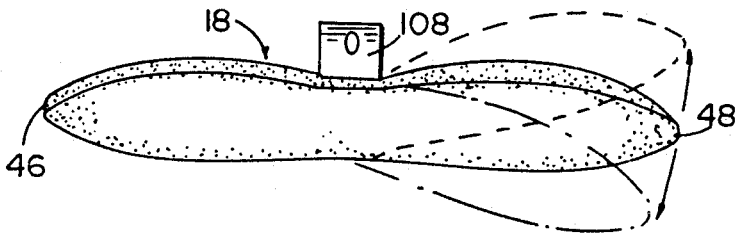
FIG. 3 is a top plan view of the back of the chair of FIG. 1 showing lateral rotation of the thoracic portion of the back, in phantom.

While thoracic support arm 76 may be connected with thoracic portion 32 through a slide and track type of connecting device (not shown), thoracic support arm 76 preferably has a telescoping upper portion with an outer sleeve 104 and an inner shaft 106 which slides within outer sleeve 104 (FIGS. 1 and 4). This provides a telescopic connection between thoracic portion 32 and control 16 whereby thoracic portion 32 may freely pivot or recline rearward relative to seat 14, pivoting about lumbar portion 40. Further, thoracic support arm 76 is preferably connected with thoracic portion 32 by a ball and socket joint 108 so that thoracic support arm 76 and thoracic portion 32 are generally hingedly connected relative to rearward or reclining motion of thoracic portion 32 and so that thoracic support arm 76 and thoracic portion 32 are pivotally connected relative to lateral twisting of thoracic portion 32 (FIGS. 1–3).

A pair of generally L-shaped lumbar support arms 110 are pivotally connected with control housing 62 and extend rearward and upward to pivotally connect with lumbar portion 40 (FIGS. 1, 5, and 6). As mentioned above, lumbar portion has a generally convex longitudinal curvature. This convex curvature defines an arc with an apex 112 and lumbar support arms 110 are preferably pivotally connected with lumbar portion 40 at apex 112 (FIG. 2).

Lumbar support arms 110 are generally parallel, L-shaped members pivotally connected at an end 114, with lumbar portion 40, near opposing lateral edges 46 and 48 of structural shell 48 (FIG. 1). Each lumbar support arm 110 is also connected at an end 116, with a bight portion 118 (FIGS. 4 and 9). Thus, the combined structure of lumbar support arms 110 and bight portion 118 is a generally U-shaped member having the two legs of the U-shaped member bent over one side (FIGS. 1 and 9). Bight portion 118 is a generally rectangular plate member having opposed mounting brackets 120 and 122. Each mounting bracket is positioned near each end of bight portion 118 for pivotally mounting bight portion 118, and in turn lumbar support arms 110 to control housing 62 at pivot 124 (FIG. 9).

Lumbar support arms 110 are biased toward a generally upright position by a lumbar energy mechanism 126, provided in a forward portion of the control housing 62 (FIGS. 5–7 and 9). Arms 110, bight portion 118, and energy mechanism 126 comprise lumbar support 22. Lumbar energy mechanism 126 is quite similar to thoracic energy mechanism 80 and comprises lumbar springs 128, a bearing plate 130 pivotally connected with control housing 62, a lever arm slide plate 132 slideably mounted to bight portion 118, a pressure plate 134, and a pressure finger 136.

As with thoracic energy mechanism 80, lumbar springs bear 128 against bearing plate 130 and pressure plate 134 (FIG. 9). Each lumbar spring 128 is positioned over a telescoping safety rod 138 which extends between and connects between bearing plate 130 and pressure plate 134, maintaining bearing plate 130 and pressure plate 134 in a generally parallel orientation relative to each other. Pressure finger 136 projects generally away from lumbar springs 128 and toward slide plate 132 from pressure plate 134. Finger 136 is generally centered on pressure plate 134 and slideably engages a diagonal groove 140 formed in a face of slide plate 132 which faces pressure plate 134.

A threaded adjusting rod 144 is fixed to slide plate 132 at one end of the slide plate (FIG. 4). Adjusting rod 144 extends through mounting bracket 122 and engages a second control nut (not shown). The control nut is rotatably mounted with mounting bracket 122 and connected with a hand grip 146 for rotating the control nut. As hand grip 146 is manipulated, slide plate 132 is pushed or pulled laterally relative to bight portion 118 (FIGS. 7 and 9). As slide plate 132 moves laterally relative to bight portion 118, it also moves laterally relative to pressure plate 134 and pressure finger 136. Thus, pressure finger 136 slides along groove 140 and the diagonal orientation of groove 140 moves pressure finger 136 nearer to or farther from pivot 124. This changes the geometry by which lumbar springs 128 exert force and the lumbar biasing energy is adjusted accordingly. As discussed in greater detail in commonly assigned U.S. Pat. No. 5,042,876, entitled CONTROLLER FOR SEATING AND THE LIKE and issued on Aug. 27, 1991 to Faiks, which is incorporated herein by reference and which discloses a similar geometry in a different structure, the biasing force is adjusted by modifying the pivot moment arm, without changing the spring force.

Figure 8:
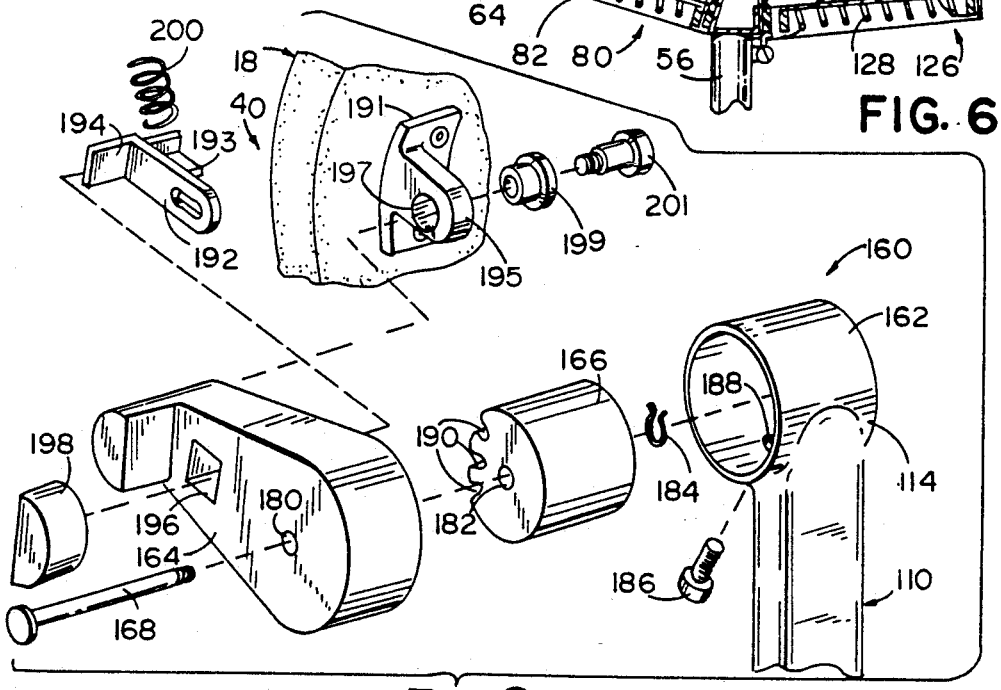
FIG. 8 is an exploded perspective view of a seat back height adjustment mechanism of the chair of FIG. 1.

Each lumbar support arm 110 is pivotally connected with lumbar portion 40 through a height adjusting mechanism 160 for adjusting the height of back 18 relative to seat 14 (FIGS. 1, 2, and 4). Each adjusting mechanism 160 has a cylindrical body portion 162 attached at end 114 of each thoracic support arm 110 (FIG. 8). An elongated lever member 164 projects generally forward from body portion 162 and pivotally connects with lumbar portion 40 at apex 112 (FIG. 2).

Lever 164 is pivotally mounted on a stub shaft 166 which projects from body portion 162 (FIG. 8). A pivot pin 168 is positioned through an aperture 180 in lever 164 and a corresponding aperture 182 in stub shaft 166 for pivotally connecting lever 164 with stub shaft 166. Pivot pin 168 is in turn secured with a C-clip 184. Stub shaft 166 is secured in body portion 162 by a screw 186 screwed through a threaded aperture 188 in body portion 162.

Stub shaft 166 has a series of stop notches 190 for cooperating engagement with a slide pin 192 slideably mounted in lever 164 (FIG. 8). Slide pin 192 slides along at least a portion of the length of lever 164 and includes a portion 193 which moves into and out of engagement with stop notches 190. A tab 194 projects from the side of slide pin 192 and through an aperture 196 in lever 164 for manipulation of slide pin 192 by the user. A finger grip 198 has a corresponding aperture (not shown) for force fit of grip 198 on tab 194. Slide pin 192 and portion 193 are biased toward engagement with stop notches 190 by a spring 200.

As further shown in FIG. 8, lever 164 is also pivotally connected with lumbar portion 40 of back 18, most preferably at apex 112. A flange bracket 191 is fastened to back 18 and has a projecting flange 195 with an aperture 197 for receiving a bushing 199. Bushing 199 receives a pivot screw or pin 201 which is fastened with lever 164.

Chair 10 is also preferably provided with a pair of side arms 202, having tubular support portions 204 extending outward and upward from control housing 62 and having padded arm rest portions 206 atop each support portion 204 for receiving and supporting the user's arms (FIGS. 1, 2, and 4). A chair height adjustment actuator 208 is conveniently located on one of the tubular support portions 204 adjacent to and below the corresponding arm rest portion 206 (FIG. 1). Actuator 208 may be connected to pneumatic height adjustment mechanism 60 in base column 50 by a cable 210 or the like which is threaded through the tubular support portion 204 (FIG. 7).

Operation

In use, chair 10 is quite comfortable and supportive by providing sympathetic support of the user's back. The lumbar portion 40 of back 18 is guided in a rearward and downward translation relative to seat 14 by lumbar support 22 (FIG. 5). Lumbar support 22 comprises height adjustment mechanism 160, lumbar support arms 110, and lumbar energy mechanism 126. Lumbar energy mechanism 126 imparts a biasing force through lumbar support arms 110 to lumbar portion 40. The magnitude of the biasing force may be adjusted at lumbar energy mechanism 126 by rotation of hand grip 146. As discussed above in greater detail, manipulation of hand grip 146 modifies the geometry of lumbar energy mechanism 126 and changes the biasing force applied through lumbar support arms 110 to lumbar portion 40.

Lumbar portion 40 is pivotally connected through height adjustment mechanism 160 to lumbar support arms 110. Thus, rotation of lumbar support arms 110 does not impart a rotation to lumbar portion 40 and lumbar portion 40 is free to follow the rotational inclinations of the user's lower back area. Further, the relative height of back 18 above seat 14 may be adjusted through manipulation of height adjustment mechanism 160, discussed above.

Thoracic portion 32 of back 18 is guided in a downward and rearward translation relative to seat 14 by thoracic support 20. Thoracic support 20 comprises thoracic support arm 76 and synchrotilt mechanism 64, including thoracic energy mechanism 80. Thoracic energy mechanism 80 imparts a biasing force through thoracic support arm 76 to thoracic portion 32. The magnitude of this biasing force may be adjusted at thoracic energy mechanism 80 by rotating hand grip 102 (FIG. 7). Rotation of hand grip 102 modifies the geometry of thoracic energy mechanism 80 as discussed above and changes the biasing force imparted through thoracic support arm 76 to thoracic portion 32.

Thoracic portion 32 is connected to thoracic support arm 76 through a ball and socket joint 108 and a telescoping mechanism defined by inner shaft 106 and outer sleeve 104 (FIGS. 5 and 6). Thus, in conjunction with the pivotable connection of lumbar portion 40, thoracic portion 32 moves freely rearward, following the movement of the user's upper or thoracic back region, independently of lumbar support 22. As shown in FIG. 3, thoracic portion 32 also follows lateral twisting of the user's upper back area because of the connection of thoracic portion 32 to thoracic support arm 76, through ball and socket joint 108.

The above description is considered that of the preferred embodiments only. Modifications of the invention will occur to those skilled in the art and to those who make or use the invention. Therefore, it is understood that the embodiment shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A chair, comprising:

a base;

a seat operably connected with said base;

a control operably connected with said base and disposed generally underneath said seat;

a back operably connected with said control and having a lumbar portion positioned to contact at least a portion of a lower back area of a seated adult user, and having a thoracic portion thereof positioned to contact at least a portion of an upper back area of the user;

a first support having an upper portion connected with said thoracic portion and having a lower portion pivotally mounted in said control so that said first support pivots about a generally transverse axis and said thoracic portion rotates rearward with respect to said seat; and a second support having an upper portion connected with said lumbar portion and having a lower portion pivotally mounted in said control so that said second support pivots about a generally transverse axis and said lumbar portion rotates rearward with respect to said seat, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support.

2. The chair defined in claim 1 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

3. The chair defined in claim 2 wherein said control includes a first means for resiliently and continuously biasing said first support toward an upright position so that said thoracic portion normally, continuously contacts the back of the user throughout substantially all normal seated positions, and a second means for resiliently and continuously biasing said second support toward an upright position so that said lumbar portion normally, continuously contacts the back of the user throughout substantially all normal seated positions.

4. The chair defined in claim 1 wherein said second support is pivotally connected with said lumbar portion so that said lumbar portion pivots about a transverse horizontal axis.

5. A chair, comprising:

a base;

a seat operably connected with said base;

a control operably connected with said base and disposed generally underneath said seat;

a back operably connected with said control, said back having a lumbar portion positioned to contact at least a portion of a lower back area of a seated adult user, having a thoracic portion thereof positioned to contact at least a portion of an upper back area of the user, and having a flexible transition area extending between and interconnecting said thoracic and lumbar portions, said flexible transition area providing a substantially continuous support surface for the user's back and providing independent movement of said thoracic and lumbar portions for said thoracic and lumbar portions to independently follow the upper and lower areas of the user's back, respectively, and provide firm, sympathetic support of the user's back;

a first support having an upper portion connected with said thoracic portion by an articulated joint so that said thoracic portion rotates about at least a generally transverse horizontal axis relative to said back and a generally longitudinal axis relative to said back and having a lower portion pivotally mounted in said control so that said first support pivots about a generally transverse axis and said thoracic portion rotates rearward with respect to said seat; and a second support having an upper portion connected with said lumbar portion and having a lower portion pivotally mounted in said control so that said second support pivots about a generally transverse axis and said lumbar portion rotates rearward with respect to said base, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support;

said control including a first means for resiliently and continuously biasing said first support toward an upright position so that said thoracic portion normally, continuously contacts the back of the user throughout substantially all normal seated positions, and a second means for resiliently and continuously biasing said second support toward an upright position so that said lumbar portion normally, continuously contacts the back of the user throughout substantially all normal seated positions.

6. The chair defined in claim 5 wherein said first support includes a slide interposed between said thoracic portion and said control so that a relative distance between said first support connection with said thoracic portion and said first support pivotable mount in said control varies.

7. The chair defined in claim 5 wherein said upper portion of said first support includes a sleeve member adapted to receive a shaft portion and a corresponding shaft portion connected in sliding engagement with said sleeve portion, said shaft portion having an end away from said control, said end being connected with said thoracic portion.

8. The chair defined in claim 7 wherein said second support is pivotally connected with said lumbar portion so that said lumbar portion pivots about a transverse horizontal axis.

9. The chair defined in claim 7 wherein said lumbar portion has a generally convex longitudinal curvature with an apex and said second support is connected with said lumbar portion near the apex.

10. The chair defined in claim 9 wherein said upper portion of said second support includes a first arm connected with said back near a first lateral edge and a second arm connected with said back near a second lateral edge, opposite said back from the first lateral edge.

11. The chair defined in claim 10 wherein said seat has a forward area connected in sliding engagement with a forward portion of said control for forward and rearward sliding of said seat relative to said control and a rear area connected with said lower portion of said first support for downward and rearward movement of said seat rear area with rotation of said first support relative to said control whereby said seat slides and tilts rearward with rearward rotation of said first support.

12. A chair, comprising:

a base;

a seat operably connected with said base;

a control operably connected with said base and disposed generally underneath said seat;

a back operably connected with said control, said back having a lumbar portion positioned to contact at least a portion of a lower back area of a seated adult user and having a thoracic portion thereof positioned to contact at least a portion of an upper back area of the user;

a first support having an upper portion connected with said thoracic portion by an articulated joint so that said thoracic portion rotates about at least a generally transverse horizontal axis relative to said back and a generally longitudinal axis relative to said back and having a lower portion pivotally mounted in said control so that said first support pivots about a generally transverse axis and said thoracic portion rotates rearward with respect to said seat; and a second support having an upper portion connected with said lumbar portion and having a lower portion pivotally mounted in said control so that said second support pivots about a generally transverse axis and said lumbar portion rotates rearward with respect to said base, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support.

13. A chair, comprising:

a base;

a seat operably connected with said base;

a control operably connected with said base and disposed generally underneath said seat;

a back operably connected with said control, said back having a lumbar portion positioned to contact at least a portion of a lower back area of a seated adult user and having a thoracic portion thereof positioned to contact at least a portion of an upper back area of the user;

a first support having an upper portion connected with said thoracic portion, having a lower portion pivotally mounted in said control so that said first support pivots about a generally transverse axis and said thoracic portion rotates rearward with respect to said seat, and including a slide interposed between said thoracic portion and said control so that a relative distance between said first support connection with said thoracic portion and said first support pivotable mount in said control varies; and a second support having an upper portion connected with said lumbar portion and having a lower portion pivotally mounted in said control so that said second support pivots about a generally transverse axis and said lumbar portion rotates rearward with respect to said base, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support.

14. A chair, comprising:

a base;

a seat operably connected with said base;

a control operably connected with said base and disposed generally underneath said seat;

a back operably connected with said control, said back having a lumbar portion positioned to contact at least a portion of a lower back area of a seated adult user and having a thoracic portion thereof positioned to contact at least a portion of an upper back area of the user;

a first support having an upper portion connected with said thoracic portion and having a lower portion pivotally mounted in said control so that said first support pivots about a generally transverse axis and said thoracic portion rotates rearward with respect to said seat, said upper portion including a sleeve member adapted to receive a shaft portion and a corresponding shaft portion connected in sliding engagement with said sleeve portion, said shaft portion having an end away from said control, said end being connected with said thoracic portion; and a second support having an upper portion connected with said lumbar portion and having a lower portion pivotally mounted in said control so that said second support pivots about a generally transverse axis and said lumbar portion rotates rearward with respect to said base, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support.

15. A chair, comprising:

a base;

a seat operably connected with said base;

a control operably connected with said base and disposed generally underneath said seat;

a back operably connected with said control, said back having a lumbar portion positioned to contact at least a portion of a lower back area of a seated adult user and having a thoracic portion thereof positioned to contact at least a portion of an upper back area of the user;

a first support having an upper portion connected with said thoracic portion and having a lower portion pivotally mounted in said control so that said first support pivots about a generally transverse axis and said thoracic portion rotates rearward with respect to said seat; and a second support having an upper portion connected with said lumbar portion and having a lower portion pivotally mounted in said control so that said second support pivots about a generally transverse axis and said lumbar portion rotates rearward with respect to said base, said thoracic and lumbar portions rotating independently of each other so that said lumbar and thoracic portions independently follow the lower and upper areas, respectively, of the back of the user to achieve a natural, free-floating chair back motion and to provide generally continuous, sympathetic back support;

said seat having a forward area connected in sliding engagement with a forward portion of said control for forward and rearward sliding of said seat relative to said control and a rear area connected with said lower portion of said first support for downward and rearward movement of said seat rear area with rotation of said first support relative to said control whereby said seat slides and tilts rearward with rearward rotation of said first support.

16. A chair, comprising:

a base;

a seat operably connected with said base;

a back having a lumbar portion positioned to contact at least a portion of a lower back area of a seated adult user and having a thoracic portion positioned to contact at least a portion of an upper back area of the user;

a first control operably connecting said thoracic portion with said base so that said thoracic portion rotates rearward with respect to said seat, said first control including means for resiliently and continuously biasing the thoracic portion toward an upright position so that said thoracic portion normally, continuously contacts the back of the user throughout substantially all normal seated positions; and a second control operably connecting said lumbar portion with said base so that said lumbar portion rotates rearward with respect to said seat, said second control including means for resiliently and continuously biasing said lumbar portion toward an upright position so that said lumbar portion normally, continuously contacts the back of the user throughout substantially all normal seated positions, said lumbar and thoracic portions rotating independently so that said lumbar and thoracic portions are normally and substantially in continuous contact with the back of the user and independently follow the lower and upper areas, respectfully, of the back of the user, achieving a natural, free-floating chair back motion and providing generally continuous, sympathetic back support.

17. The chair defined in claim 16 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

18. The chair defined in claim 16 wherein said second control is pivotally connected with said lumbar portion so that said lumbar portion pivots about a transverse horizontal axis.

19. The chair defined in claim 16 wherein said first control includes:

an arm connected with said thoracic portion at a first end and pivotally connected with said base at a first pivot opposite said arm from said first end;

a first energy source for exerting a biasing force between said arm and said base so that said thoracic portion is resiliently and continuously biased toward an upright position, said first energy source having a first end pivotally connected with said arm and a second end, opposite said first energy source from said first end, connected in sliding engagement with said base near said first pivot;

a first slide plate connecting said first energy source second end in sliding engagement with said base, said first slide plate being positioned between and adapted to slide between said first energy source and said base, said first slide plate having a diagonally oriented groove facing said first energy source, said first energy source second end having a corresponding finger projecting into said groove so that said second end moves nearer to and farther from said first pivot as said first slide plate slides between said first energy source and said base; and first adjustment means for sliding and positioning said first slide plate.

20. A chair, comprising:

a base;

a seat operably connected with said base;

a back having a lumbar portion positioned to contact at least a portion of a lower back area of a seated adult user, having a thoracic portion positioned to contact at least a portion of an upper back area of the user and having a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower area of the user's back, respectively, and provide firm, sympathetic support of the user's back;

a first control operably connecting said thoracic portion with said base so that said thoracic portion rotates rearward with respect to said base, said first control being connected with said thoracic portion by an articulated joint so that said thoracic portion rotates about at least a generally transverse horizontal axis relative to said back and a generally longitudinal axis relative to said back, said first control including means for resiliently and continuously biasing the thoracic portion toward an upright position so that said thoracic portion normally, continuously contacts the back of the user throughout substantially all normal seated positions; and a second control operably connecting said lumbar portion with said base so that said lumbar portion rotates rearward with respect to said base, said second control including means for resiliently and continuously biasing said lumbar portion toward an upright position so that said lumbar portion normally, continuously contacts the back of the user throughout substantially all normal seated positions, said lumbar and thoracic portions rotating independently so that said lumbar and thoracic portions are normally and substantially in continuous contact with the back of the user and independently follow the lower and upper areas, respectfully, of the back of the user, achieving a natural, free-floating chair back motion and providing generally continuous, sympathetic back support.

21. The chair defined in claim 20 wherein said first control includes a telescoping arm connected between said thoracic portion and said base.

22. The chair defined in claim 21 wherein said second control is pivotally connected with said lumbar portion so that said lumbar portion pivots about a transverse horizontal axis.

23. The chair defined in claim 22 wherein said lumbar portion has a generally convex longitudinal curvature with an apex and said second support is connected with said lumbar portion near the apex.

24. The chair defined in claim 23 wherein said second control includes a first arm connected with said back near a first lateral edge and a second arm connected with said back near a second lateral edge, opposite said back from the first lateral edge.

25. A chair, comprising:

a base;

a seat operably connected with said base;

a back having a lumbar portion positioned to contact at least a portion of a lower back area of a seated adult user and having a thoracic portion positioned to contact at least a portion of an upper back area of the user;

a first control operably connecting said thoracic portion with said base so that said thoracic portion rotates rearward with respect to said base, said first control being connected with said thoracic portion by an articulated joint so that said thoracic portion rotates about at least a generally transverse, horizontal axis relative to said back and a generally longitudinal axis relative to said back, said first control including means for resiliently and continuously biasing the thoracic portion toward an upright position so that said thoracic portion normally, continuously contacts the back of the user throughout substantially all normal seated positions; and a second control operably connecting said lumbar portion with said base so that said lumbar portion rotates rearward with respect to said base, said second control including means for resiliently and continuously biasing said lumbar portion toward an upright position so that said lumbar portion normally, continuously contacts the back of the user throughout substantially all normal seated positions, said lumbar and thoracic portions rotating independently so that said lumbar and thoracic portions are normally and substantially in continuous contact with the back of the user and independently follow the lower and upper areas, respectfully, of the back of the user, achieving a natural, free-floating chair back motion and providing generally continuous, sympathetic back support.

26. A chair, comprising:

a base;

a seat operably connected with said base;

a back having a lumbar portion positioned to contact at least a portion of a lower back area of a seated adult user and having a thoracic portion positioned to contact at least a portion of an upper back area of the user;

a first control operably connecting said thoracic portion with said base so that said thoracic portion rotates rearward with respect to said base, said first control including means for resiliently and continuously biasing the thoracic portion toward an upright position so that said thoracic portion normally, continuously contacts the back of the user throughout substantially all normal seated positions; and a second control operably connecting said lumbar portion with said base so that said lumbar portion rotates rearward with respect to said base, said second control including:

an arm assembly connected with said lumbar portion at a first end and pivotally connected with said base at a second pivot opposite said arm assembly from said first end;

a second energy source for exerting a biasing force between said arm assembly and said base so that said lumbar portion is resiliently and continuously biased toward an upright position so that said lumbar portion normally, continuously contacts the back of the user throughout substantially all normal seated positions, said second energy source having a first end pivotally connected with said base and a second end, opposite said second energy source from said first end, connected in sliding engagement with said arm assembly near said second pivot;

a second slide plate connecting said second energy source second end in sliding engagement with said arm assembly, said second slide plate being positioned between and adapted to slide between said second energy source and said arm assembly, said second slide plate having a diagonally oriented groove facing said second energy source, said second energy source second end having a corresponding finger projecting into said groove so that said second energy source second end moves nearer to and farther from said second pivot as said second slide plate slides between said second energy source and said arm assembly; and second adjustment means for sliding and positioning said second slide plate;

said lumbar and thoracic portions rotating independently so that said lumbar and thoracic portions are normally and substantially in continuous contact with the back of the user and independently follow the lower and upper areas, respectfully, of the back of the user, achieving a natural, free-floating chair back motion and providing generally continuous, sympathetic back support.

27. A chair, comprising:

a base;

a seat operably connected with said base;

a back having a lumbar portion positioned to contact at least a portion of a lower back area of a seated adult user and having a thoracic portion positioned to contact at least a portion of an upper back area of the user;

a first support operably connecting said thoracic portion with said base so that said thoracic portion rotates rearward with respect to said base and twists laterally for additional comfort and freedom of movement at the upper back area of the user; and a second support operably connecting said lumbar portion with said base so that said lumbar portion rotates rearward with respect to said base, said thoracic portion and said lumbar portion rotating independently of each other.

28. The chair defined in claim 27 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

29. The chair defined in claim 28 wherein said first support includes a first means for resiliently and continuously biasing said thoracic portion toward an upright position so that said thoracic portion normally, continuously contacts the back of the user throughout substantially all normal seated positions.

30. The chair defined in claim 29 wherein said second support includes a second means for resiliently and continuously biasing said lumbar portion toward an upright position so that said lumbar portion normally, continuously contacts the back of the user throughout substantially all normal seated positions.

31. The chair defined in claim 30 wherein said first support is connected with said thoracic portion by an articulated joint so that said thoracic portion rotates about at least a generally transverse horizontal axis relative to said back and a generally longitudinal axis relative to said back.

32. The chair defined in claim 31 further including slide means for sliding connection of said first support with said thoracic portion.

33. The chair defined in claim 31 wherein said first support includes a sleeve member adapted to receive a shaft portion and a corresponding shaft portion connected in sliding engagement with said sleeve portion, said shaft portion having an end away from said base, said end being connected with said thoracic portion.

34. The chair defined in claim 33 wherein said second support is pivotally connected with said lumbar portion so that said lumbar portion pivots about a transverse horizontal axis.

35. The chair defined in claim 34 wherein said lumbar portion has a generally convex longitudinal curvature with an apex and said second support is connected with said lumbar portion near the apex.

36. The chair defined in claim 35 wherein said second support includes a first arm connected with said back near a first lateral edge and a second arm connected with said back near a second lateral edge, opposite said back from the first lateral edge.

37. The chair defined in claim 27 wherein said first support is connected with said thoracic portion by an articulated joint so that said thoracic portion rotates about at least a generally transverse horizontal axis relative to said back and a generally longitudinal axis relative to said back.

38. The chair defined in claim 27 wherein said second support is pivotally connected with said lumbar portion so that said lumbar portion pivots about a transverse horizontal axis.

* * * * *